US009592590B2

(12) United States Patent
Chen et al.

(10) Patent No.: US 9,592,590 B2
(45) Date of Patent: Mar. 14, 2017

(54) ADJUSTABLE WRENCH

(71) Applicants: Kung-Cheng Chen, Taichung (TW); Pei-Yang Lee, Taichung (TW)

(72) Inventors: Kung-Cheng Chen, Taichung (TW); Pei-Yang Lee, Taichung (TW)

( * ) Notice: Subject to any disclaimer, the term of this patent is extended or adjusted under 35 U.S.C. 154(b) by 0 days.

(21) Appl. No.: 14/845,873

(22) Filed: Sep. 4, 2015

(65) Prior Publication Data

US 2016/0089770 A1 Mar. 31, 2016

(30) Foreign Application Priority Data

Sep. 26, 2014 (TW) ..... 103133492

(51) Int. Cl.
*B25B 13/46* (2006.01)
*B25B 13/16* (2006.01)
*B25B 13/14* (2006.01)

(52) U.S. Cl.
CPC ..... *B25B 13/46* (2013.01); *B25B 13/14* (2013.01)

(58) Field of Classification Search
CPC ..... B25B 13/14; B25B 13/46
USPC ..... 81/58.2
See application file for complete search history.

(56) References Cited

U.S. PATENT DOCUMENTS 4,706,528 A * 11/1987 Inoue ..... B25B 13/46 81/129
7,827,887 B2 * 11/2010 Lee ..... B25B 13/08 81/179
8,408,101 B2 * 4/2013 Liu ..... B25B 13/46 81/179
2003/0154830 A1 * 8/2003 Wu ..... B25B 13/46 81/186
2003/0183048 A1 * 10/2003 Olsen ..... B25B 13/04 81/179
2004/0031359 A1 * 2/2004 Kady ..... B25B 13/08 81/179
2009/0193941 A1 * 8/2009 Chiu ..... B25B 13/14 81/165
2010/0071516 A1 * 3/2010 Wu ..... B25B 13/46 81/176.1

(Continued)

FOREIGN PATENT DOCUMENTS

JP 3181599 U * 2/2013 ..... B25B 13/08
TW EP 2896483 A1 * 7/2015 ..... B25B 13/46

*Primary Examiner* — Joseph J Hail
*Assistant Examiner* — Marc Carlson
(74) *Attorney, Agent, or Firm* — C. G. Mersereau; Nikolai & Mersereau, P.A.

(57) ABSTRACT

An adjustable wrench has a wrench body, a clamping element, and a ratcheting jaw. The wrench body has a handle, a head, and a thumbscrew. The head is formed on the handle and has a connecting block, a fixed jaw, a curved slot, two pin holes, a positioning pin, a mounting recess, two pivot holes, and a sliding slot. The clamping element is connected to the wrench body and has a sliding bar, a ribbed slab, and a movable jaw. The ribbed slab is formed on the sliding bar and is mounted in the sliding slot. The movable jaw has an engaging surface and a positioning block. The ratcheting jaw is a curved block capable of sliding forward and retracting backward inside the curved slot and has two mounting boards, a receiving recess, an engaging surface, an abutting surface, an engaging protrusion, a holding recess, and an elastic element.

24 Claims, 11 Drawing Sheets

(56) References Cited

U.S. PATENT DOCUMENTS

| | | | | |
|---|---|---|---|---|
| 2011/0146463 | A1* | 6/2011 | Stanton | B25B 13/08 81/129 |
| 2011/0277599 | A1* | 11/2011 | Liu | B25B 13/46 81/179 |
| 2011/0277600 | A1* | 11/2011 | Liu | B25B 13/46 81/179 |
| 2011/0308360 | A1* | 12/2011 | Hu | B25B 13/46 81/179 |
| 2013/0055859 | A1* | 3/2013 | Wu | B25B 13/46 81/97 |
| 2013/0068071 | A1* | 3/2013 | Chen | B25B 13/14 81/165 |
| 2013/0192428 | A1* | 8/2013 | Chen | B25B 13/46 81/119 |
| 2013/0239758 | A1* | 9/2013 | Yang | B25B 13/46 81/179 |
| 2013/0327187 | A1* | 12/2013 | Hu | B25B 13/46 81/179 |
| 2014/0007745 | A1* | 1/2014 | Wu | B25B 13/46 81/179 |
| 2014/0318326 | A1* | 10/2014 | Lin | B25B 13/46 81/179 |
| 2015/0059536 | A1* | 3/2015 | Pahng | B25B 13/08 81/179 |
| 2016/0059393 | A1* | 3/2016 | Chern | B25B 23/0028 81/65 |

* cited by examiner

ADJUSTABLE WRENCH

BACKGROUND OF THE INVENTION

1. Field of the Invention

The present invention relates to an adjustable wrench, and more particularly to an adjustable wrench that has a preferred structural strength and can rotate bolts of different sizes conveniently.

2. Description of Related Art

A conventional adjustable wrench comprises a handle, a fixed jaw, a rotating shaft, and a movable jaw. The fixed jaw is formed on an end of the handle and has a curved inner side. The rotating shaft is rotatably mounted in the curved inner side of the fixed jaw to rotate in an opposite direction relative to the handle. The movable jaw is slidably mounted on the end of the handle, faces the fixed jaw and the rotating shaft to hold and rotate a hexangular head of a bolt in a backward or a forward direction. Although the conventional adjustable wrench can be used to rotate bolts of different sizes in the backward or the forward direction, the rotating direction of the rotating shaft is opposite to the rotating direction of the conventional adjustable wrench when the handle is rotated in a backward direction. Then, the conventional adjustable wrench cannot rotate backwardly with a smaller range of movement.

In addition, the movable jaw of the conventional adjustable wrench does not have a structure to block the hexangular head of the bolt. When the conventional adjustable wrench is used to rotate a small-size bolt, the engaging position between the hexangular head of the small-size bolt and the jaws of the conventional adjustable wrench is deeper than the engaging position between the hexangular head of the ordinary-size bolt and the jaws of the conventional adjustable wrench. When the conventional adjustable wrench is rotated, the corners of the hexangular head of the small-size bolt may be worn and torn by the jaws of the conventional adjustable wrench. Furthermore, when a hexangular head of a bolt is rotated by the conventional adjustable wrench, and the movable jaw abuts aslant against a flat of the hexangular head of the bolt. Because an inner side of the movable jaw is flat and the inner side of the movable jaw cannot securely abut against the flat of the hexangular head of the bolt when the movable jaw abuts aslant against the flat of the hexangular head of the bolt, this may reduce the torque of the conventional adjustable wrench and cannot prevent the hexangular head of the bolt escaping from the fixed jaw and the movable jaw. Then, the user cannot rotate the hexangular head of the bolt conveniently.

To overcome the shortcomings, the present invention provides an adjustable wrench to mitigate or obviate the aforementioned problems.

SUMMARY OF THE INVENTION

The main objective of the present invention is to provide an adjustable wrench that has a preferred structural strength and can rotate bolts of different sizes conveniently.

The adjustable wrench in accordance with the present invention has a wrench body, a clamping element, and a ratcheting jaw. The wrench body has a handle, a head, and a thumbscrew. The head is formed on the handle and has a connecting block, a fixed jaw, a curved slot, two pin holes, a positioning pin, a mounting recess, two pivot holes, and a sliding slot. The clamping element is movably connected to the wrench body and has a sliding bar, a ribbed slab, and a movable jaw. The sliding bar is slidably mounted in the sliding slot and engages the thumbscrew. The ribbed slab is formed on the sliding bar and is mounted in the sliding slot. The movable jaw has an engaging surface and a positioning block. The ratcheting jaw is a curved block capable of sliding forward and retracting backward inside the curved slot and has two mounting boards, a receiving recess, an engaging surface, an abutting surface, an engaging protrusion, a holding recess, and an elastic element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
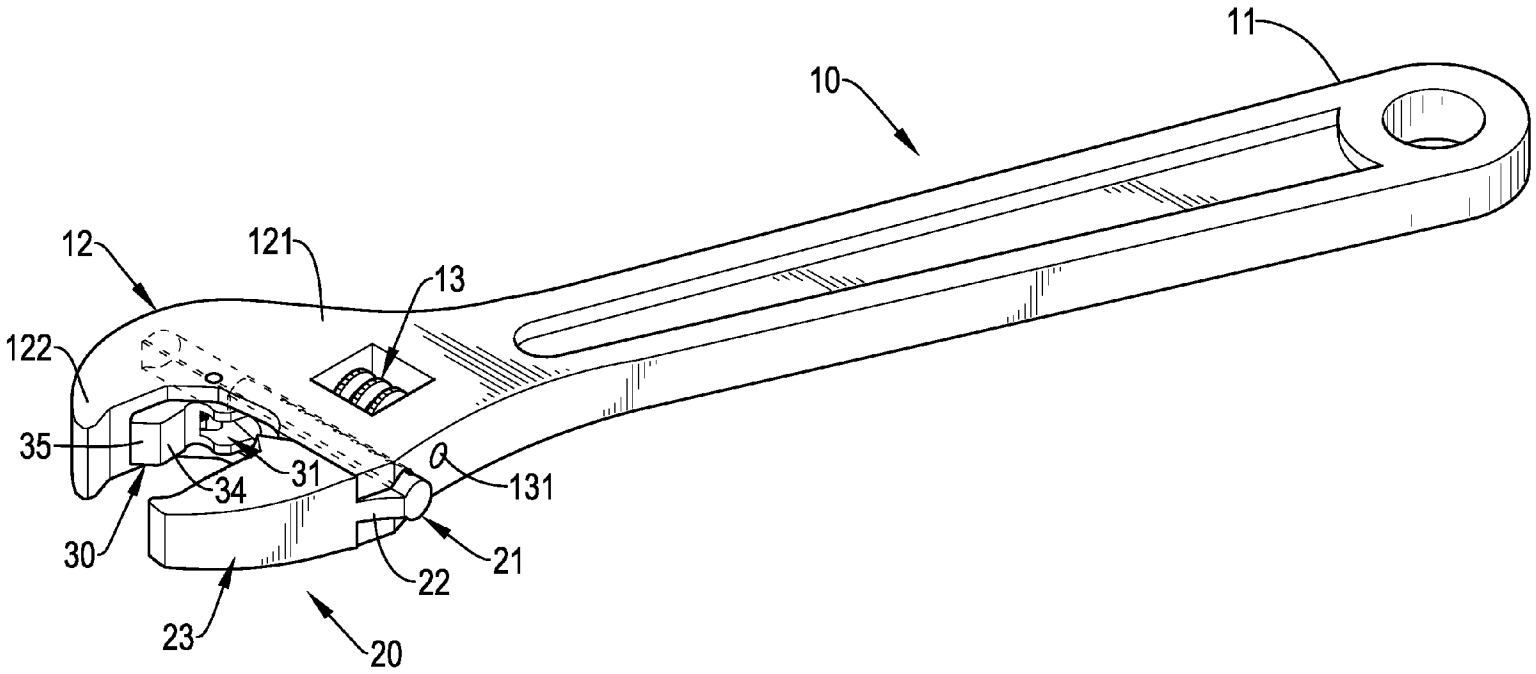
FIG. 1 is a perspective view of an adjustable wrench in accordance with the present invention.
Figure 2:
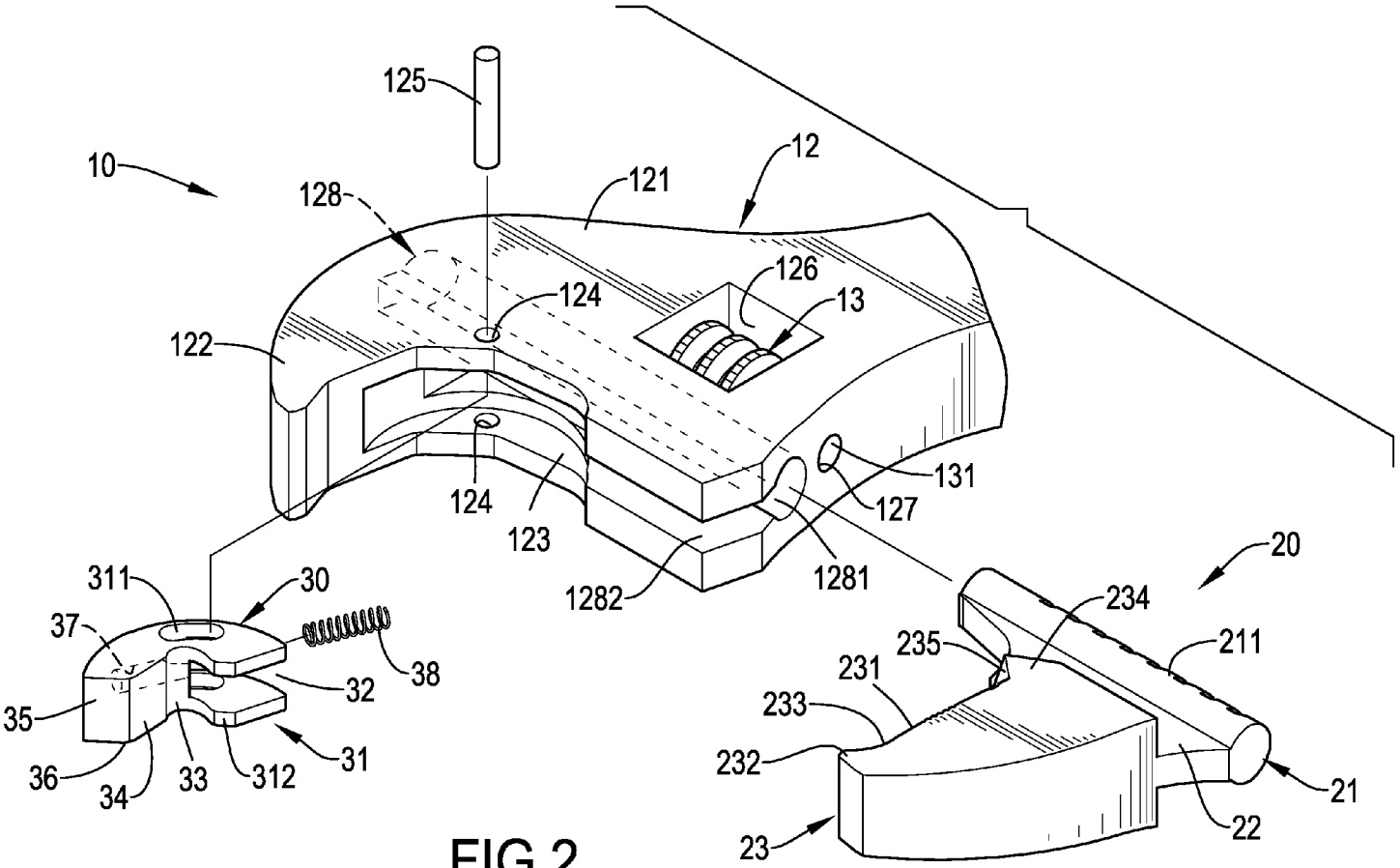
FIG. 2 is an enlarged and exploded perspective view of the adjustable wrench in FIG. 1.
Figure 3:
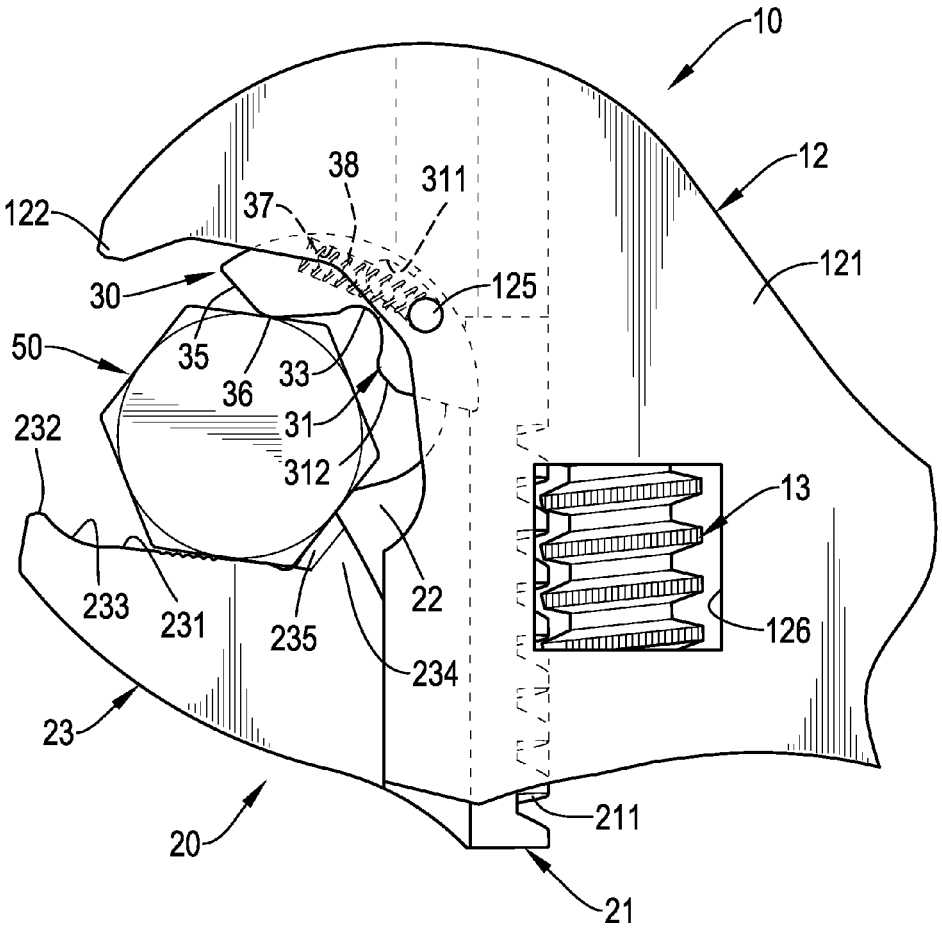
FIG. 3 is an enlarged top view of the adjustable wrench in FIG. 1.

With reference to FIGS. 1 to 3, an adjustable wrench in accordance with the present invention comprises a wrench body 10, a clamping element 20, and a ratcheting jaw 30.

The wrench body 10 is elongated and has a handle 11, a head 12, and a thumbscrew 13. The handle 11 has a front end and a rear end. The head 12 is formed on the front end of the handle 11 and has a top side, a bottom side, two sidewalls, a connecting block 121, a fixed jaw 122, a curved slot 123, two pin holes 124, a positioning pin 125, a mounting recess 126, two pivot holes 127, and a sliding slot 128.

With reference to FIG. 2, the connecting block 121 is formed on and protrudes from the front end of the handle 11 and has an upper side, a front side, a top side, and a bottom side. The width of the connecting block 121 at the front side of the connecting block 121 is wider than the width of the connecting block 121 at the rear side of the connecting block 121. The fixed jaw 122 is formed on and protrudes from the upper side of the connecting block 121, is opposite to the front end of the handle 11, and has an inner side.

The curved slot 123 is formed in the connecting block 121 and the fixed jaw 122 between the front side of the connecting block 121 and the inner side of the fixed jaw 122 to form the two sidewalls of the head 12, and has an inner surface, a forward end, and a backward end. The inner surface of the curved slot 123 is curved and may be a single curved surface or a multi-curved surface. The forward end of the curved slot 123 is formed in the front side of the connecting block 121 and is opposite to the fixed jaw 122. The backward end of the curved slot 123 is formed in the inner side of the fixed jaw 122. In the present invention, a backward end is defined as an end heading toward the backward direction during a ratcheting rotation of the head 12 in the backward direction. Opposite to the backward end, a forward end is defined as an end heading toward the forward direction while the head 12 is being rotated in the forward direction.

The pin holes 124 are respectively formed through the two sidewalls of the head 12 and communicate with the curved slot 123. The positioning pin 125 may be a rivet or a screw and is inserted through the pin holes 124 and the curved slot 123. The mounting recess 126 may be rectangular and is formed through the top side and the bottom side of the connecting block 121 and has two opposite inner sides. The opposite inner sides of the mounting recess 126 face to each other. The pivot holes 127 are respectively formed through the opposite inner sides of the mounting recess 126, are formed through the connecting block 121, and align with each other.

The sliding slot 128 is formed through the front side of the connecting block 121, communicates with the curved slot 123 and the mounting recess 126, and has a bar-shaped slot 1281 and a board-shaped slot 1282. The bar-shaped slot 1281 is formed through the connecting block 121, communicates with the mounting recess 126, and has a width. The board-shaped slot 1282 is formed through the front side of the connecting block 121, communicates with the curved slot 123 and the bar-shaped slot 1281, and has a width. The width of the board-shaped slot 1282 is narrower than the width of the bar-shaped slot 1281.

Figure 4:
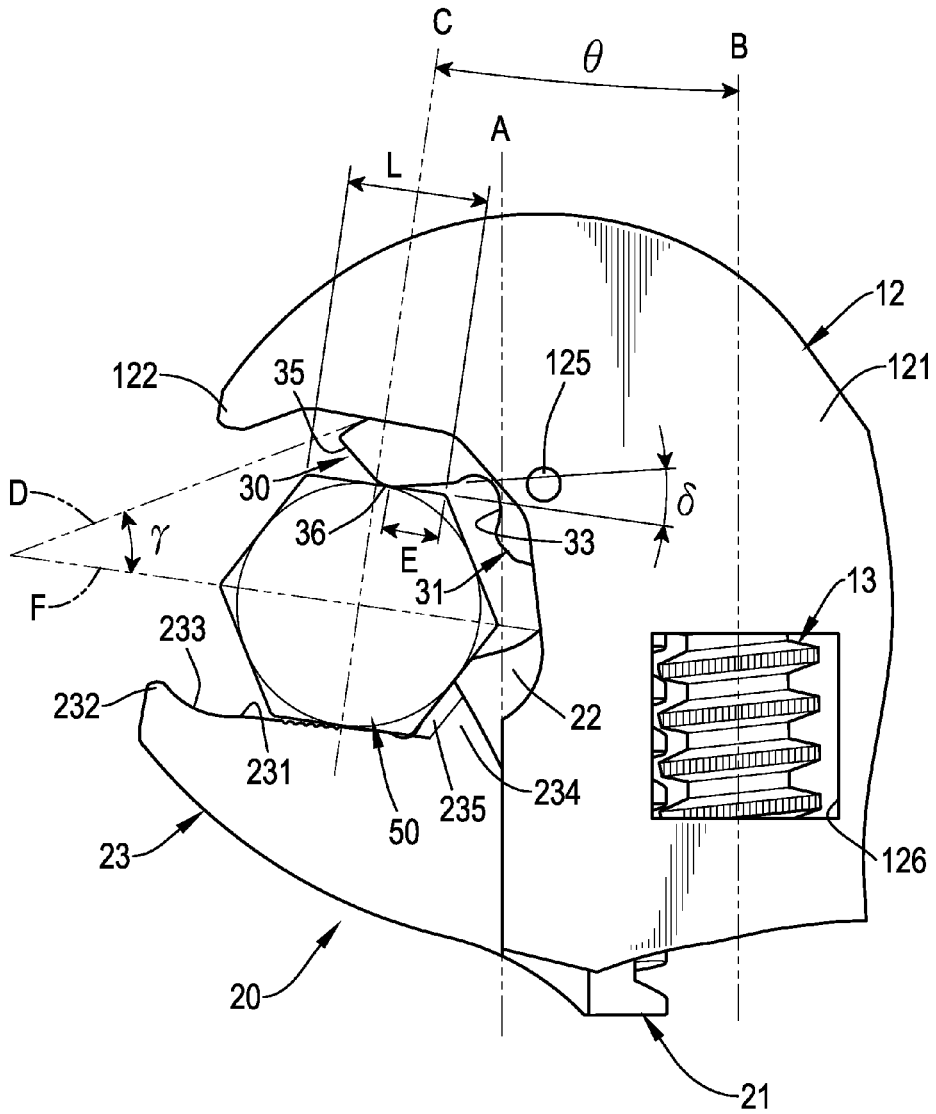
FIG. 4 is another enlarged top view of the adjustable wrench in FIG. 1.

The thumbscrew 13 is rotatably mounted in the mounting recess 126 of the head 12, extends into the bar-shaped slot 1281 of the sliding slot 128, and has an axial line B and a pivot rod 131. The pivot rod 131 is axially mounted in and extends through the thumbscrew 13 along the axial line B, and is mounted in the pivot holes 127 of the head 12 via the mounting recess 126 to enable the thumbscrew 13 to be rotatably mounted in the head 12. With reference to FIG. 4, an extending line A extends along the front side of the connecting block 121 and is parallel with the axial line B of the thumbscrew 13.

The clamping element 20 is movably connected to the wrench body 10 and has a rear end, a front end, a sliding bar 21, a ribbed slab 22, and a movable jaw 23.

The sliding bar 21 is formed on the rear end of the clamping element 20, is slidably mounted in the bar-shaped slot 1281 of the sliding slot 128, engages the thumbscrew 13, and has a rear side, a front side and multiple teeth 211. The teeth 211 are formed on and protrude from the rear side of the sliding bar 21, are spaced apart at intervals, extend into the mounting recess 126 and engage the thumbscrew 13 to enable the sliding bar 21 to move relative to the head 12 when the thumbscrew 13 is rotated relative to the head 12.

The ribbed slab 22 is formed on and protrudes from the front side of the sliding bar 21, is mounted in the board-shaped slot 1282 of the sliding slot 128 and has a front side and an inner side. The front side of the ribbed slab 22 extends out of the front side of the connecting block 121 via the board-shaped slot 1282 of the sliding slot 128. The inner side of the ribbed slab 22 faces the curved slot 123 of the head 12.

The movable jaw 23 is formed on and protrudes from the front side of the ribbed slab 22 opposite to the sliding bar 21, faces the fixed jaw 122 to hold and rotate a hexangular head 50 of a bolt and has a rear end, a front end, an inner side, an engaging surface 231, a limiting protrusion 232, a front notch 233, a positioning block 234, two contacting faces 235, a rear notch 236, and multiple limiting notches 237. The rear end of the movable jaw 23 is formed on and protrudes from the front side of the ribbed slab 22.

The engaging surface 231 is formed on the inner side of the movable jaw 23 between the rear end and the front end of the movable jaw 23, faces the inner side of the fixed jaw 122 and the curved slot 123 and has a normal line C perpendicular to the engaging surface 231 as shown in FIG. 4. Furthermore, an angle θ between the normal line C of the engaging surface 231 and the axial line B of the thumbscrew 13 is between 1.5 and 15 degrees. In addition, with reference to FIG. 5, when a hexangular head 50 of a bolt is mounted between the fixed jaw 122 and the movable jaw 23, an angle α between the engaging surface 231 of the movable jaw 23 and a flat of the hexangular head 50 that abuts the movable jaw 23 is between 0 and 5 degrees.

Figure 6:
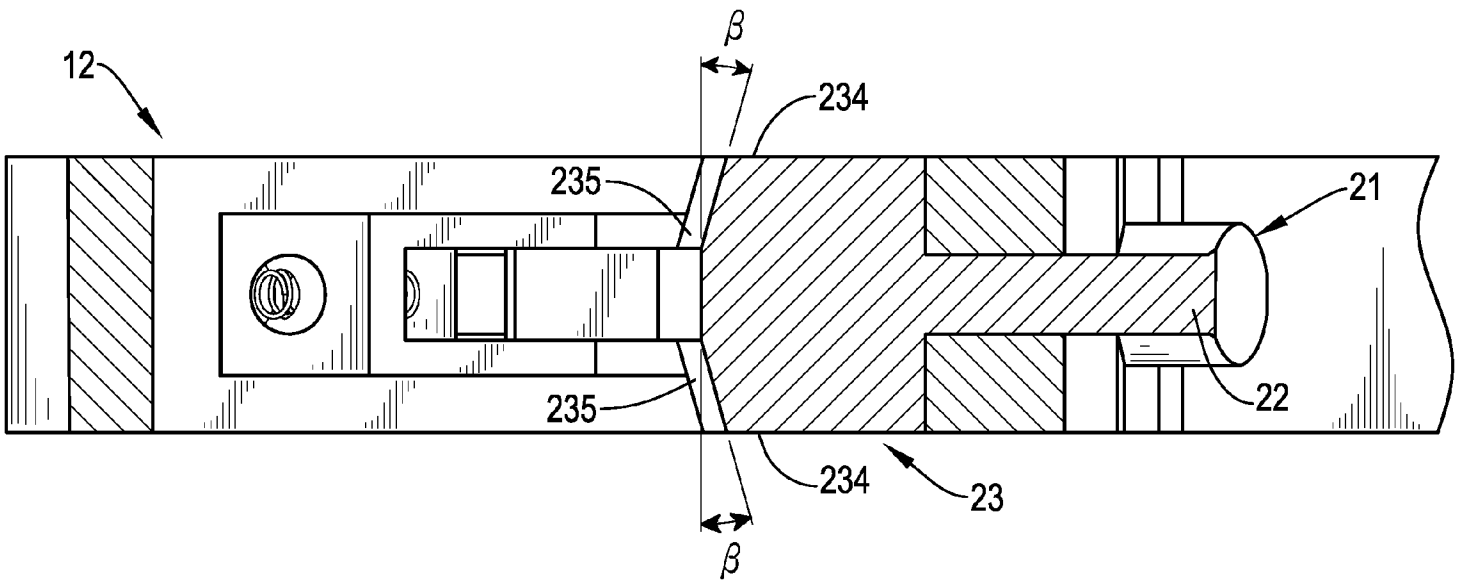
FIG. 6 is an enlarged side view in partial section of the adjustable wrench in FIG. 1.

The limiting protrusion 232 is formed on the front end of the movable jaw 23. The front notch 233 is formed in the inner side of the movable jaw 23 between the limiting protrusion 232 and the engaging surface 231 of the movable jaw 23. With reference to FIGS. 4 and 6, the positioning block 234 is formed on and protrudes upwardly from the inner side of the movable jaw 23 at the rear end of the movable jaw 23, and has an inner side. The two contacting surfaces 235 are formed on the inner side of the positioning block 234, and each one of the contacting surfaces 235 has an angle β relative to the inner side of the positioning block 234 between 0 and 20 degrees. The rear notch 236 is formed in the inner side of the movable jaw 23 between the engaging surface 231 and the positioning block 234. The limiting notches 237 are formed in the engaging surface 231 and between the front notch 233 and the rear notch 236, and the limiting notches 237 are spaced apart at intervals.

The ratcheting jaw 30 is a curved block capable of sliding forward and retracting backward inside the curved slot 123 of the head 12 and has a backward area, a forward area, an outer surface, an inner surface, a front portion, a rear portion, two mounting boards 31, a receiving recess 32, an inner notch 33, an engaging surface 34, an abutting surface 35, an engaging protrusion 36, a holding recess 37, and an elastic element 38. The backward area of the ratcheting jaw 30 is defined within the ratcheting jaw 30 as an area heading toward the backward direction during a ratcheting rotation of the head 12 in the backward direction. Opposite to the backward area, the forward area of the ratcheting jaw 30 is defined within the ratcheting jaw 30 as an area heading toward the forward direction while the head 12 is being rotated in the forward direction.

The outer surface of the ratcheting jaw 30 has a shape that corresponds to the inner surface of the curved slot 123 to allow the ratcheting jaw 30 to slide inside the curved slot 123 of the head 12. The inner surface of the ratcheting jaw 30 faces the inner side of the movable jaw 23 to enable the hexangular head 50 of the bolt to be held between the inner surface of the ratcheting jaw 30 and the inner side of the movable jaw 23.

The two mounting boards 31 are formed on the rear portion of the ratcheting jaw 30, are spaced apart at an interval, are parallel with each other, and are slidably mounted in the curved slot 123 of the head 12. Each one of the mounting boards 31 has a top face, a bottom face, a front side, a guide hole 311, and a pressing protrusion 312. The guide hole 311 is a curved hole, is formed through the top face and the bottom face of the mounting board 31, aligns with the guide hole 311 of the other mounting board 31, and has a backward area and a forward area. The backward area of the guide hole 311 is defined within the guide hole 311 as an area heading toward the backward direction during a ratcheting rotation of the head 12 in the backward direction. Opposite to the backward area, the forward area of the guide hole 311 is defined within the guide hole 311 as an area heading toward the forward direction while the head 12 is being rotated in the forward direction. The positioning pin 125 is mounted through the guide holes 31 via the pin holes 124. More precisely, the positioning pin 125 is mounted through the curved slot 123 and the forward areas of the guide holes 311 of the mounting boards 31. The pressing protrusion 312 is formed on and protrudes from the front side of the mounting board 31.

The receiving recess 32 is formed in the ratcheting jaw 30 between the two mounting boards 31 and communicates with guide holes 311 of the two mounting boards 31. In addition, when the ratcheting jaw 30 is slidably moved toward the clamping element 20, the receiving recess 32 is disposed around the ribbed slab 22 to prevent the two mounting boards 31 from interfering with and impacting on the clamping element 20. The inner notch 33 is formed in the inner surface of the ratcheting jaw 30 at the front portion of the ratcheting jaw 30 adjacent to the two mounting boards 31. The engaging surface 34 is formed on the inner surface of the ratcheting jaw 30 adjacent to the inner notch 33, and is opposite to the two mounting boards 31.

Figure 5:
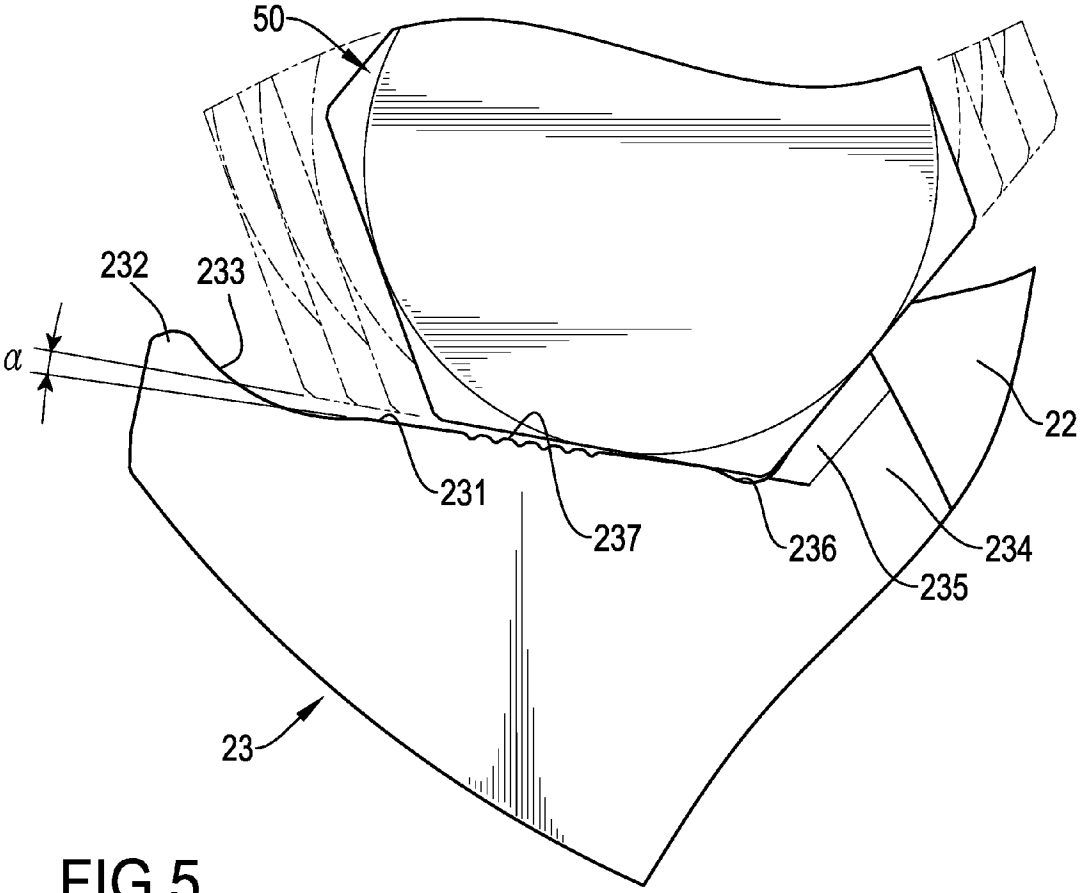
FIG. 5 is a further enlarged top view of the adjustable wrench in FIG. 3.

The abutting surface 35 is formed aslant on and protrudes from the inner surface of the ratcheting jaw 30 adjacent to the engaging surface 34, and is opposite to the inner notch 33. The engaging protrusion 36 is formed in the inner surface of the ratcheting jaw 30 between the engaging surface 34 and the abutting surface 35. With reference to FIG. 4, when one of the flats of the hexangular head 50 abuts against the engaging protrusion 36, an angle $\delta$ is formed between a tangent line of the engaging protrusion 36 and the corresponding flat of the hexangular head 50, and is larger than or equal to the angle $\alpha$ that is formed between the engaging surface 231 of the movable jaw 23 and the hexangular head 50 as shown in FIG. 5 ($\delta \geq \alpha$).

The holding recess 37 is formed in the rear portion of the ratcheting jaw 30, communicates with the receiving recess 32 and the two guide holes 311, and has a closed inner end. The elastic element 38 may be a spring or an elastic sheet, is mounted in the holding recess 37, and has two ends. The two ends of the elastic element 38 respectively abut the closed inner end of the holding recess 37 and the positioning pin 125.

With reference to FIG. 4, a hexangular head 50 of a bolt has multiple flats and multiple corners formed between adjacent flats. When engaging the hexangular head 50 of the bolt between the ratcheting jaw 30 and the movable jaw 23 of the clamping element 20, the engaging protrusion 36 and the engaging surface 231 will respectively engage two of the flats of the hexangular head 50 of the bolt. When the hexangular head 50 of the bolt is mounted between the jaws 30, 23, a flat that is formed at a rear side of the hexangular head 50 of the bolt will be pressed against by the front side of the ribbed slab 22. Each one of the flats of the hexangular head 50 has a total length L, and an engaging length E of a flat of the hexangular head 50 is defined between the engaging protrusion 36 contacting and engaging the flat of the hexangular head 50 and the inner notch 33. A length percentage (E/L) of the flat of the hexangular head 50 is between 30% and 90%. In addition, an angle $\gamma$ is formed between a tangent line D of the outer surface of the ratcheting jaw 30 at the front portion and a center line F of the hexangular head 50 of the bolt, and the angle $\gamma$ is between 15 and 30 degrees. Furthermore, a gap is formed between the positioning block 234 of the movable jaw 23 and the hexangular head 50 of the bolt.

In the present invention, the ribbed slab 22 is formed between the sliding bar 21 and the movable jaw 23 to increase the structural strength of the clamping element 20, and the receiving recess 32 is formed in the ratcheting jaw 30 between the two mounting boards 31 to prevent the two mounting boards 31 from interfering with and impacting on the clamping element 20 when the clamping element 20 is moved toward the fixed jaw 122 or when the ratcheting jaw 30 is slidably moved toward the clamping element 20 relative to the fixed jaw 122.

Figure 7A:
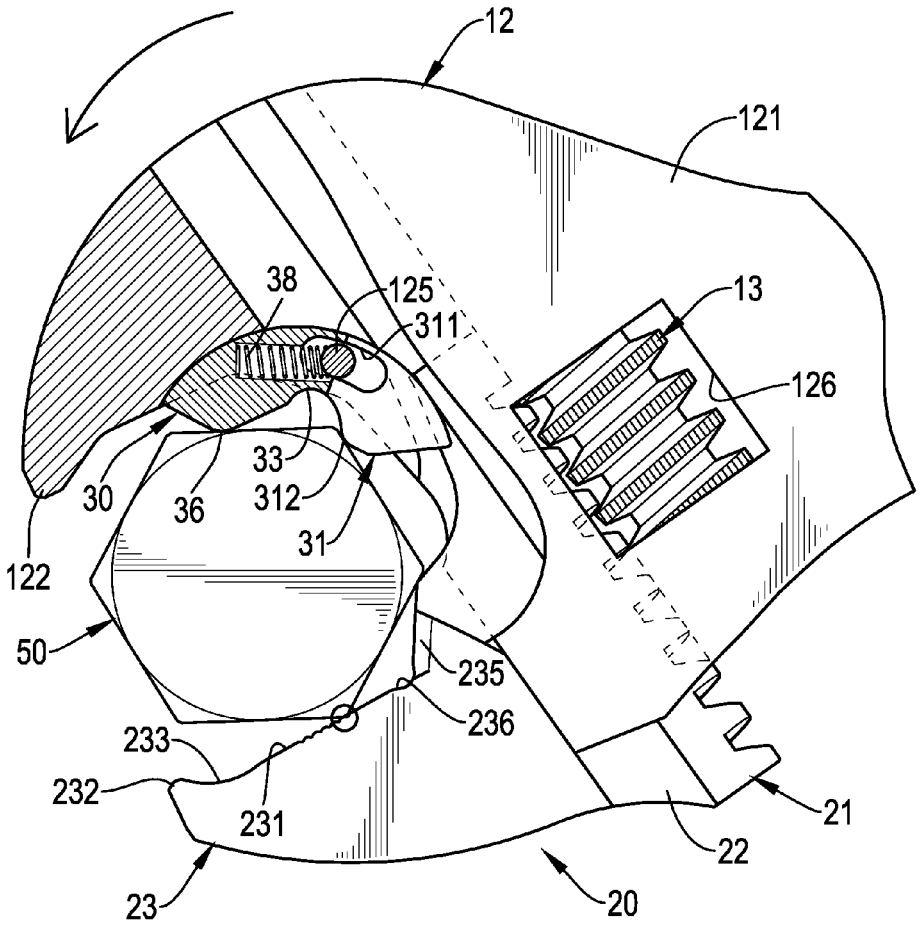
FIG. 7A is an operational top view in partial section of the adjustable wrench in FIG. 1 being rotated in a backward direction with a larger-size bolt.

In the present invention, we define that a bolt is rotated to be fastened in a forward direction, for example, clockwise, and is rotated to be loosened in a counterclockwise direction as shown in FIG. 7A. With reference to FIGS. 1 and 3, a user holds the handle 11 of the wrench body 10 and mounts a hexangular head 50 of a bolt between the ratcheting jaw 30 and the clamping element 20. In addition, a distance between the fixed jaw 122 and the movable jaw 23 is equal to a distance between two of the flats of the hexangular head 50 of the bolt that face to each other. Then, when the user wants to rotate a hexangular head 50 of a bolt, the distance between the fixed jaw 122 and the movable jaw 23 can be used as a measuring stick to estimate a size of the hexangular head 50 of the bolt, and the user can mount the hexangular head 50 of the bolt between the fixed jaw 122, the movable jaw 23, and the ratcheting jaw 30 without substantially adjusting the distance between the fixed jaw 122 and the movable jaw 23.

When the hexangular head 50 of the bolt is mounted between the fixed jaw 122, the movable jaw 23, and the ratcheting jaw 30, the user can rotate the thumbscrew 13 to enable the movable jaw 23 to move toward the hexangular head 50 of the bolt. Then, two of the flats of the hexangular head 50 can be respectively pressed between the engaging surface 231 of the movable jaw 23 and the engaging protrusion 36 of the ratcheting jaw 30. In addition, the front side of the ribbed slab 22 and the inner side of the positioning block 234 are pressed against a flat that is formed at a rear side of the hexangular head 50 of the bolt. When the movable jaw 23 abuts against the hexangular head 50 of the bolt, the angle $\alpha$ is formed between the engaging surface 231 and the hexangular head 50 of the bolt as shown in FIG. 5, and the angle $\gamma$ is formed between the tangent line D of the outer surface of the ratcheting jaw 30 and the center line F of the hexangular head 50 of the bolt and is between 15 and 30 degrees as shown in FIG. 4. Therefore, the hexangular head 50 of the bolt can be securely clamped between the ratcheting jaw 30 and the movable jaw 23 and this can prevent the hexangular head 50 of the bolt departing from the fixed jaw 122 and the movable jaw 23 when the adjustable wrench is used to rotate the hexangular head 50 of the bolt.

The adjustable wrench in accordance with the present invention can be applied to the hexangular heads 50 of bolts of different sizes. Preferably, the adjustable wrench can be applied to the hexangular heads 50 of bolts of the size more than 6 millimeters. With reference to FIG. 4, an angle θ between the normal line C of the engaging surface 231 and the axial line B of the thumbscrew 13 is between 1.5 and 15 degrees, and the front side of the ribbed slab 22 and the inner side of the positioning block 234 are pressed against a flat that is formed at a rear side of the hexangular head 50 of the bolt, and this can enable the engaging protrusion 36 of the ratcheting jaw 30 to engage hexangular heads 50 of different sizes at the position where the length percentage (E/L) of the engaging protrusion 36 contacting and engaging the hexangular heads 50 is between 30% and 90% of the total length L of the corresponding flat of the hexangular heads 50. When the head 12 is rotated backwardly, the hexangular head 50 can push the ratcheting jaw 30 to rotate forwardly in a clockwise direction to move into the curved slot 123 of the head 12, and this can prevent the ratcheting jaw 30 from sticking with the hexangular heads 50 and can prevent the head 12 rotating unsmoothly. Because the rotating radian of the ratcheting jaw 30 is same as the rotating radian of the head 12, the ratcheting jaw 30 and the movable jaw 23 can be used to hold and engage the hexangular heads 50 of different sizes.

When the user rotates the head 12 in a clockwise direction to fasten the bolt, the hexangular head 50 of the bolt is rotated in the same direction. Because the length percentage (E/L) of the engaging protrusion 36 contacting and engaging the hexangular heads 50 is between 30% and 90% of the total length L of the corresponding flat of the hexangular head 50, the hexangular head 50 of the bolt can be rotated smoothly in a clockwise direction. During the rotating process, the corners of the hexangular head 50 are respectively moved at the notches 233, 236, 33 and this can prevent the corners of the hexangular head 50 from knocking against the jaws 23, 30.

Figure 7B:
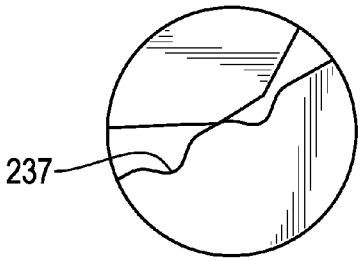
FIG. 7B is an enlarged and operational top view of the adjustable wrench in FIG. 7A.

With reference to FIGS. 7A and 7B, when the head 12 is rotated backwardly in a counterclockwise direction at the original position, the hexangular head 50 will abut the abutting surface 35 to push the ratcheting jaw 30 to rotate forwardly in a clockwise direction into the curved slot 123 to press the elastic element 38. Because the ratcheting jaw 30 is rotated and moved along the curved inner surface of the curved slot 123, this can fit with the rotating direction of the head 12 to enable the head 12 to rotate in a counterclockwise direction by a minimum action without departing the hexangular head 50 of the bolt from the fixed jaw 122 and the movable jaw 23. Then, the user can rotate the hexangular head 50 of the bolt conveniently and quickly by the adjustable wrench of the present invention.

During the above-mentioned rotating process (the head 12 is rotated in a counterclockwise direction), the front notch 233 can press and push the corner of the hexangular head 50 to move inwardly to the rear end of the movable jaw 23 and can prevent the hexangular head 50 from slipping out of the jaws 23, 30. In addition, when the hexangular head 50 is rotated with the movable jaw 23 and the ratcheting jaw 30, the corners of the hexangular head 50 can escape from direct contact with the movable jaw 23 and the ratcheting jaw 30, thereby preventing wearing and tearing by the jaws 23, 30. After rotating the head 12 backwardly in a counterclockwise direction, the user can rotate the head 12 forwardly in a clockwise direction to enable the engaging protrusion 36 of the ratcheting jaw 30 and the engaging surface 231 of the movable jaw 23 to press the flats of the hexangular head 50, and enable the front side of the ribbed slab 22 and the inner side of the positioning block 234 to press against a flat that is formed at a rear side of the hexangular head 50 of the bolt. Then, the head 12 can be rotated again in a clockwise direction by the user to rotate the hexangular head 50 of the bolt.

Figure 8A:
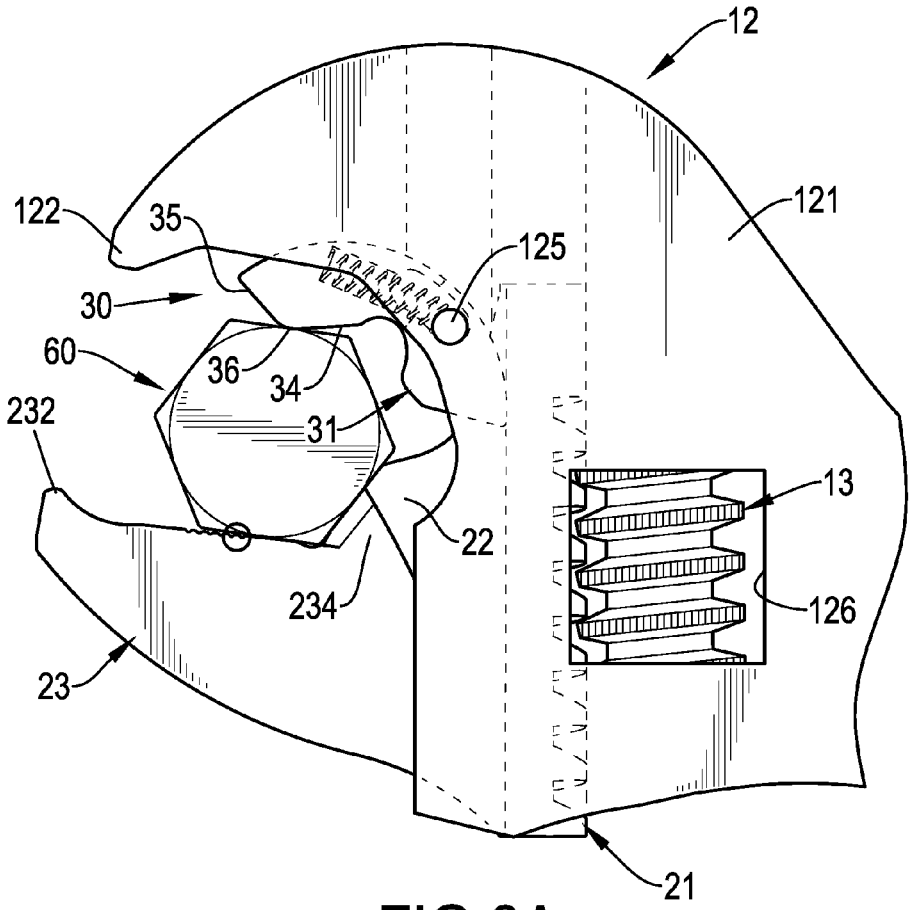
FIG. 8A is an operational top view of the adjustable wrench in FIG. 1 being rotated in a backward direction with a small-size bolt.
Figure 8B:
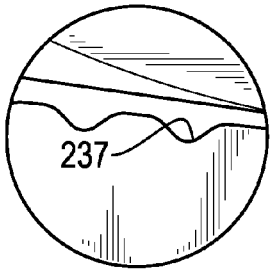
FIG. 8B is an enlarged and operational top view of the adjustable wrench in FIG. 8A.

With reference to FIGS. 8A and 8B, when the adjustable wrench in accordance with the present invention is used on a bolt having a small-size hexangular head 60, in the same way, the small-size hexangular head 60 is mounted between the ratcheting jaw 30 and the clamping element 20 and the thumbscrew 13 is rotated to enable the movable jaw 23 to move toward the hexangular head 60. Then, two of the flats of the small-size hexangular head 60 can be respectively pressed between the engaging surface 231 of the movable jaw 23 and the engaging protrusion 36 of the ratcheting jaw 30. In addition, the front side of the ribbed slab 22 and the inner side of the positioning block 234 will abut one of the flats of the hexangular head 60, and the hexangular head 60 can be prevented from moving inwardly between the jaws 23, 30. In addition, the length percentage (E/L) of the engaging protrusion 36 contacting and engaging the small-size hexangular heads 60 is still controlled between 30% and 90% of the total length L of the corresponding flat of the small-size hexangular heads 60. Therefore, the small-size hexangular head 60 can be rotated smoothly in a clockwise direction, and the ratcheting jaw 30 also can be rotated in a clockwise direction along the curved slot 123.

Figure 9:
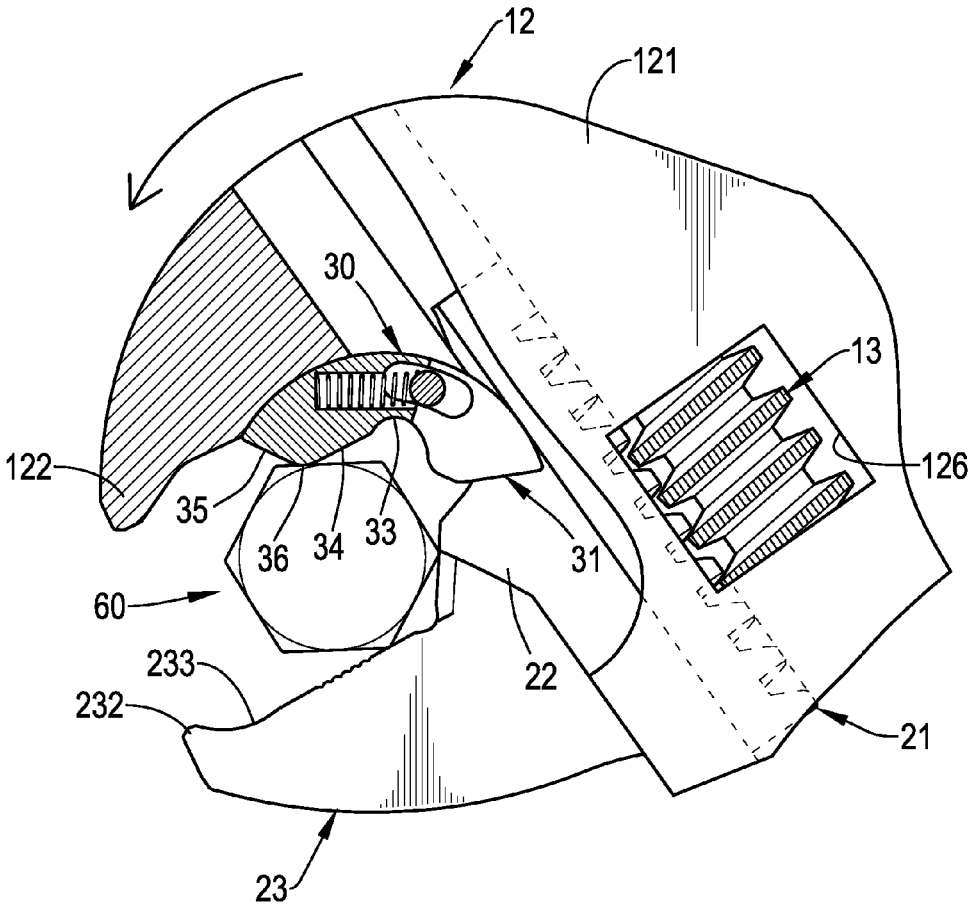
FIG. 9 is another operational top view in partial section of the adjustable wrench in FIG. 8A being rotated in a backward direction with a small-size bolt.

With reference to FIG. 9, when the head 12 is rotated backwardly in a counterclockwise direction at the original position, the small-size hexangular head 60 will abut the abutting surface 35 to push the ratcheting jaw 30 to rotate forwardly in a clockwise direction into the curved slot 123 to press the elastic element 38. Because the ratcheting jaw 30 is rotated and moved along the curved inner surface of the curved slot 123, this can fit with the rotating direction of the head 12 to enable the head 12 to rotate in a counterclockwise direction by a minimum action without departing the small-size hexangular head 60 of the bolt from the fixed jaw 122 and the movable jaw 23. Then, the user can rotate the small-size hexangular head 50 of the bolt conveniently and quickly by the adjustable wrench of the present invention.

During the above-mentioned rotating process (the head 12 is rotated in a counterclockwise direction), the limiting notch 237 can press and push the corner of the small-size hexangular head 60 to move inwardly to the rear end of the movable jaw 23 and can prevent the small-size hexangular head 60 from slipping out of the jaws 23, 30. In addition, the inner notch 33 and the rear notch 236 also can be used to accommodate passing of the corners of the small-size hexangular head 60 to avoid direct contact with the movable jaw 23 and the ratcheting jaw 30 when the small-size hexangular head 60 is rotated with jaws 23, 30, and this can prevent the corners of the small-size hexangular head 60 from wearing and tearing by the jaws 23, 30. After rotating the head 12 backwardly in a counterclockwise direction, the user can rotate the head 12 forwardly in a clockwise direction to enable the engaging protrusion 36 of the ratcheting jaw 30 and the engaging surface 231 of the movable jaw 23 to press the flats of the small-size hexangular head 60, and enable the front side of the ribbed slab 22 to press against a flat that is formed at a rear side of the small-size hexangular head 60 of the bolt. Then, the head 12 can be rotated again in a clockwise direction by the user to rotate the small-size hexangular head 60 of the bolt.

Figure 10:
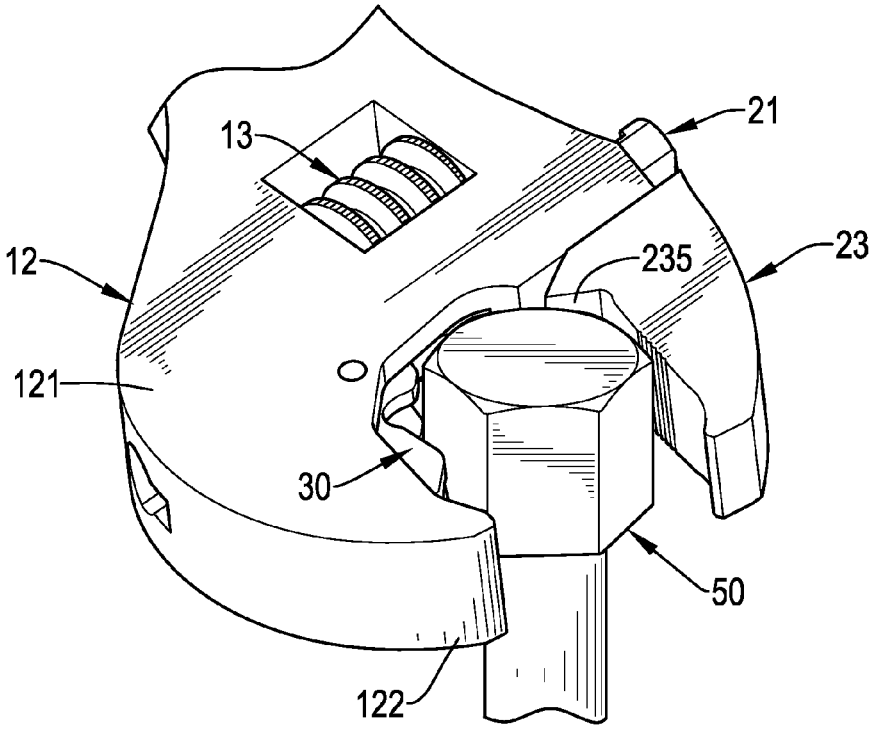
FIG. 10 is an operational perspective view of the adjustable wrench in FIG. 1 being rotated with a hexangular head of a bolt.
Figure 11:
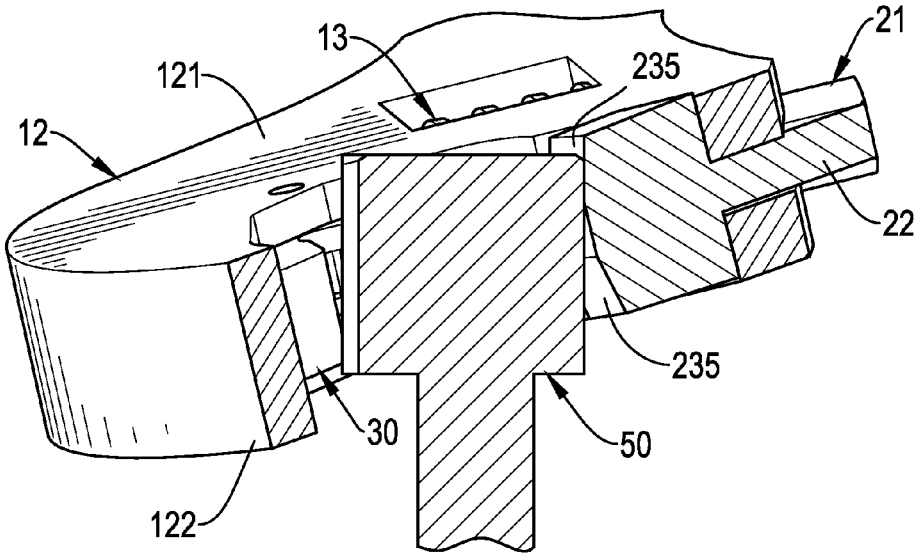
FIG. 11 is an operational side view of the adjustable wrench in FIG. 10.

With further reference to FIGS. 10 and 11, a user rotates a hexangular head 50 of a bolt by the adjustable wrench of the present invention, when the movable jaw 23 abuts aslant a flat of the hexangular head 50 of the bolt, one of the contacting faces 235 adjacent to the positioning block 234 securely abuts the flat of the hexangular head 50 of the bolt, and this can avoid reducing the torque of the adjustable wrench and can prevent the hexangular head 50 of the bolt escaping from the fixed jaw 122 and the movable jaw 23 to enable the user to rotate the hexangular head 50 of the bolt conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the tee ins in which the appended claims are expressed.

What is claimed is:

1. An adjustable wrench having:

a wrench body having a handle having a front end and a rear end;

a head formed on the front end of the handle and having a top side;

a bottom side;

two sidewalls;

a connecting block formed on and protruding from the front end of the handle and having an upper side;

a front side;

a top side; and a bottom side;

a fixed jaw formed on and protruding from the upper side of the connecting block, being opposite to the front end of the handle, and having an inner side;

a curved slot formed in the connecting block and the fixed jaw between the front side of the connecting block and the inner side of the fixed jaw and having an inner surface being curved;

two pin holes respectively formed through the two sidewalls of the head and communicating with the curved slot;

a positioning pin inserted through the two pin holes and the curved slot;

a mounting recess formed through the top side and the bottom side of the connecting block and having two opposite sides;

two pivot holes respectively formed through the opposite inner sides of the mounting recess, formed through the connecting block, and aligning with each other; and a sliding slot formed through the front side of the connecting block and communicating with the curved slot and the mounting recess; and a thumbscrew rotatably mounted in the mounting recess of the head, extending into the sliding slot, and having an axial line; and a pivot rod axially mounted in and extending through the thumbscrew along the axial line, and mounted in the pivot holes of the head via the mounting recess;

a clamping element movably connected to the wrench body and having a rear end;

a front end;

a sliding bar formed on the rear end of the clamping element, slidably mounted in the sliding slot and engaging the thumbscrew, and having a rear side;

a front side; and multiple teeth formed on and protruding from the rear side of the sliding bar, spaced apart at intervals, extending into the mounting recess, and engaging the thumbscrew to enable the sliding bar to move relative to the head when the thumbscrew is rotated relative to the head;

a ribbed slab formed on and protruding from the front side of the sliding bar, mounted in the sliding slot, and having a front side extending out of the front side of the connecting block via the sliding slot; and an inner side facing the curved slot of the head; and a movable jaw formed on and protruding from the front side of the ribbed slab opposite to the sliding bar, facing the fixed jaw, and having a rear end formed on and protruding from the front side of the ribbed slab;

a front end;

an inner side;

an engaging surface formed on the inner side of the movable jaw between the rear end and the front end of the movable jaw, and facing the inner side of the fixed jaw and the curved slot; and a positioning block formed on and protruding upwardly from the inner side of the movable jaw at the rear end of the movable jaw, and having an inner side; and a ratcheting jaw being a curved block capable of sliding forward and retracting backward inside the curved slot of the head and having an outer surface having a shape corresponding to the inner surface of the curved slot to allow the ratcheting jaw to slide inside the curved slot of the head;

an inner surface facing the inner side of the movable jaw;

a front portion;

a rear portion;

a top face;

a bottom face;

two mounting boards formed on the rear portion of the ratcheting jaw, spaced apart at an interval, being parallel with each other, and slidably mounted in the curved slot of the head, and each one of the mounting boards having a top face;

a bottom face;

a front side;

a guide hole being a curved hole, formed through the top face and the bottom face of the mounting board, and aligning with the guide hole of the other mounting board; and a pressing protrusion formed on and protruding from the front side of the mounting board;

a receiving recess formed in the ratcheting jaw between the two mounting boards and communicating with the guide holes of the two mounting boards;

an engaging surface formed on the inner surface of the ratcheting jaw and being opposite to the two mounting boards;

an abutting surface formed aslant on and protruding from the inner surface of the ratcheting jaw adjacent to the engaging surface;

an engaging protrusion formed in the inner surface of the ratcheting jaw between the engaging surface and the abutting surface;

a holding recess formed in the rear portion of the ratcheting jaw, communicating with the receiving recess and the two guide holes, and having a closed inner end; and an elastic element mounted in the holding recess and having two ends respectively abutting the closed inner end of the holding recess and the positioning pin.

2. The adjustable wrench as claimed in claim 1, wherein the movable jaw has a limiting protrusion formed on the front end of the movable jaw;

a front notch formed in the inner side of the movable jaw between the limiting protrusion and the engaging surface of the movable jaw;

a rear notch formed in the inner side of the movable jaw between the engaging surface and the positioning block; and multiple limiting notches formed in the engaging surface and between the front notch and the rear notch, the limiting notches spaced apart at intervals; and the ratcheting jaw has an inner notch formed in the inner surface of the ratcheting jaw at the front portion of the ratcheting jaw adjacent to the two mounting boards.

3. The adjustable wrench as claimed in claim 2, wherein when the adjustable wrench is applied to hold a bolt having a hexangular head with multiple flats and multiple corners formed between adjacent flats to engage the hexangular head between the ratcheting jaw and the movable jaw of the clamping element, the engaging protrusion and the engaging surface respectively engage two of the flats of the hexangular head of the bolt, and the front side of the ribbed slab and the inner side of the positioning block are pressed against one of the flats that is formed at a rear side of the hexangular head of the bolt;

each one of the flats of the hexangular head has a total length, and an engaging length of the flat of the hexangular head is defined between the engaging protrusion contacting and engaging the flat of the hexangular head and the inner notch; and a length percentage of the engaging length of the flat of the hexangular head is between 30% and 90% of the total length of the corresponding flat of the hexangular head of the bolt that is pressed against by the engaging protrusion.

4. The adjustable wrench as claimed in claim 1, wherein the head has an extending line extending along the front side of the connecting block and being parallel with the axial line of the thumbscrew; and an angle between a normal line of the engaging surface and the axial line of the thumbscrew is between 1.5 and 15 degrees.

5. The adjustable wrench as claimed in claim 2, wherein the head has an extending line extending along the front side of the connecting block and being parallel with the axial line of the thumbscrew; and an angle between a normal line of the engaging surface and the axial line of the thumbscrew is between 1.5 and 15 degrees.

6. The adjustable wrench as claimed in claim 3, wherein the head has an extending line extending along the front side of the connecting block and being parallel with the axial line of the thumbscrew; and an angle between a normal line of the engaging surface and the axial line of the thumbscrew is between 1.5 and 15 degrees.

7. The adjustable wrench as claimed in claim 4, wherein when the adjustable wrench is applied to hold a bolt having a hexangular head with multiple flats and multiple corners formed between adjacent flats to engage the hexangular head between the ratcheting jaw and the movable jaw of the clamping element, an angle between the engaging surface of the movable jaw and a flat of the hexangular head that abuts the movable jaw is between 0 and 5 degrees; and an angle is formed between a tangent line of the engaging protrusion and one of the flats of the hexangular head that abuts against the engaging protrusion, and is larger than or equal to the angle that is formed between the engaging surface of the movable jaw and the hexangular head.

8. The adjustable wrench as claimed in claim 5, wherein when the adjustable wrench is applied to hold a bolt having a hexangular head with multiple flats and multiple corners formed between adjacent flats to engage the hexangular head between the ratcheting jaw and the movable jaw of the clamping element, an angle between the engaging surface of the movable jaw and one of the flats of the hexangular head that abuts the movable jaw is between 0 and 5 degrees; and an angle is formed between a tangent line of the engaging protrusion and one of the flats of the hexangular head that abuts against the engaging protrusion, and is larger than or equal to the angle that is formed between the engaging surface of the movable jaw and the hexangular head.

9. The adjustable wrench as claimed in claim 6, wherein an angle between the engaging surface of the movable jaw and a flat of the hexangular head that abuts the movable jaw is between 0 and 5 degrees; and an angle is formed between a tangent line of the engaging protrusion and one of the flats of the hexangular head that abuts against the engaging protrusion, and is larger than or equal to the angle that is formed between the engaging surface of the movable jaw and the hexangular head.

10. The adjustable wrench as claimed in claim 7, wherein the movable jaw has two contacting surfaces formed on the inner side of the positioning block, and each one of the contacting surfaces has an angle relative to the inner side of the positioning block between 0 and 20 degrees.

11. The adjustable wrench as claimed in claim 8, wherein the movable jaw has two contacting surfaces formed on the inner side of the positioning block, and each one of the contacting surfaces has an angle relative to the inner side of the positioning block between 0 and 20 degrees.

12. The adjustable wrench as claimed in claim 9, wherein the movable jaw has two contacting surfaces formed on the inner side of the positioning block, and each one of the contacting surfaces has an angle relative to the inner side of the positioning block between 0 and 20 degrees.

13. The adjustable wrench as claimed in claim 10, wherein the sliding slot has a bar-shaped slot formed through the connecting block, communicating with the mounting recess, and having a width; and a board-shaped slot formed through the front side of the connecting block, communicating with the curved slot and the bar-shaped slot, and having a width narrower than the width of the bar-shaped slot;

the sliding bar is slidably mounted in the bar-shaped slot of the sliding slot; and the front side of the ribbed slab extends out of the front side of the connecting block via the board-shaped slot of the sliding slot.

14. The adjustable wrench as claimed in claim 11, wherein the sliding slot has a bar-shaped slot formed through the connecting block, communicating with the mounting recess, and having a width; and a board-shaped slot formed through the front side of the connecting block, communicating with the curved slot and the bar-shaped slot, and having a width narrower than the width of the bar-shaped slot;

the sliding bar is slidably mounted in the bar-shaped slot of the sliding slot; and the front side of the ribbed slab extends out of the front side of the connecting block via the board-shaped slot of the sliding slot.

15. The adjustable wrench as claimed in claim 12, wherein the sliding slot has a bar-shaped slot formed through the connecting block, communicating with the mounting recess, and having a width; and a board-shaped slot formed through the front side of the connecting block, communicating with the curved slot and the bar-shaped slot, and having a width narrower than the width of the bar-shaped slot;

the sliding bar is slidably mounted in the bar-shaped slot of the sliding slot; and the front side of the ribbed slab extends out of the front side of the connecting block via the board-shaped slot of the sliding slot.

16. The adjustable wrench as claimed in claim 1, wherein when the adjustable wrench is applied to hold a bolt having a hexangular head with multiple flats and multiple corners formed between adjacent flats to engage the hexangular head between the ratcheting jaw and the movable jaw of the clamping element, an angle between the engaging surface of the movable jaw and one of the flats of the hexangular head that abuts the movable jaw is between 0 and 5 degrees.

17. The adjustable wrench as claimed in claim 2, wherein when the adjustable wrench is applied to hold a bolt having a hexangular head with multiple flats and multiple corners formed between adjacent flats to engage the hexangular head between the ratcheting jaw and the movable jaw of the clamping element, an angle between the engaging surface of the movable jaw and one of the flats of the hexangular head that abuts the movable jaw is between 0 and 5 degrees.

18. The adjustable wrench as claimed in claim 3, wherein an angle between the engaging surface of the movable jaw and one of the flats of the hexangular head that abuts the movable jaw is between 0 and 5 degrees.

19. The adjustable wrench as claimed in claim 16, wherein the movable jaw has two contacting surfaces formed on the inner side of the positioning block, and each one of the contacting surfaces has an angle relative to the inner side of the positioning block between 0 and 20 degrees.

20. The adjustable wrench as claimed in claim 17, wherein the movable jaw has two contacting surfaces formed on the inner side of the positioning block, and each one of the contacting surfaces has an angle relative to the inner side of the positioning block between 0 and 20 degrees.

21. The adjustable wrench as claimed in claim 18, wherein the movable jaw has two contacting surfaces formed on the inner side of the positioning block, and each one of the contacting surfaces has an angle relative to the inner side of the positioning block between 0 and 20 degrees.

22. The adjustable wrench as claimed in claim 19, wherein the sliding slot has a bar-shaped slot formed through the connecting block, communicating with the mounting recess, and having a width; and a board-shaped slot formed through the front side of the connecting block, communicating with the curved slot and the bar-shaped slot, and having a width narrower than the width of the bar-shaped slot;

the sliding bar is slidably mounted in the bar-shaped slot of the sliding slot; and the front side of the ribbed slab extends out of the front side of the connecting block via the board-shaped slot of the sliding slot.

23. The adjustable wrench as claimed in claim 20, wherein the sliding slot has a bar-shaped slot formed through the connecting block, communicating with the mounting recess, and having a width; and a board-shaped slot formed through the front side of the connecting block, communicating with the curved slot and the bar-shaped slot, and having a width narrower than the width of the bar-shaped slot;

the sliding bar is slidably mounted in the bar-shaped slot of the sliding slot; and the front side of the ribbed slab extends out of the front side of the connecting block via the board-shaped slot of the sliding slot.

24. The adjustable wrench as claimed in claim 21, wherein the sliding slot has a bar-shaped slot formed through the connecting block, communicating with the mounting recess, and having a width; and a board-shaped slot formed through the front side of the connecting block, communicating with the curved slot and the bar-shaped slot, and having a width narrower than the width of the bar-shaped slot;

the sliding bar is slidably mounted in the bar-shaped slot of the sliding slot; and the front side of the ribbed slab extends out of the front side of the connecting block via the board-shaped slot of the sliding slot.

* * * * *